US005127545A

United States Patent [19]

French

[11] Patent Number: 5,127,545

[45] Date of Patent: Jul. 7, 1992

[54] POUCH FOR HOLDING AND DISPENSING FACIAL TISSUES

[76] Inventor: R. Todd French, 46 Union St., Windsor, Vt. 05089

[21] Appl. No.: 684,042

[22] Filed: Apr. 11, 1991

[51] Int. Cl.[5] ..... A47F 1/06

[52] U.S. Cl. ..... 221/102; 221/185; 221/199; 224/219

[58] Field of Search ..... 221/46, 47, 48, 49, 221/61, 62, 97, 102, 155, 185, 199, 281; 222/175; 224/219, 221, 222, 251, 277

[56] References Cited

U.S. PATENT DOCUMENTS

| | | | |
|---|---|---|---|
| 591,215 | 10/1897 | Ganon | 221/155 X |
| 1,407,239 | 2/1922 | Weiss | 224/219 X |
| 1,724,069 | 8/1929 | Butera | 224/222 X |
| 2,854,134 | 9/1958 | Humphrey | 221/46 X |
| 3,089,597 | 5/1963 | Kaplan | 221/46 |
| 4,114,780 | 9/1978 | Sharon | 221/185 X |
| 4,185,753 | 1/1980 | Leto | 221/49 X |
| 4,401,233 | 8/1983 | Frey | 221/185 X |
| 4,896,465 | 1/1990 | Rhodes et al. | 224/219 X |
| 4,913,326 | 4/1990 | Echelson | 224/222 |
| 4,919,302 | 4/1990 | McPherson | 221/102 X |
| 4,940,160 | 7/1990 | Williams | 221/155 X |

FOREIGN PATENT DOCUMENTS 137381 2/1989 Japan .

*Primary Examiner*—D. Glenn Dayoan
*Assistant Examiner*—Dean A. Reichard
*Attorney, Agent, or Firm*—George W. Dishong

[57] ABSTRACT

A pouch, preferably made of pliable and soft material such as a moisture proof or moisture repelling fabric, designed for holding and dispensing facial tissues from small pocket sized packages which pouch is removably attachable to a selectable location of the body of the person using the pouch, preferably an arm or leg and including a closable flap which when opened exposes the facial tissue for removal and use and which flap may additionally contain such items as licenses, passes, note pads and the like. In the preferred pouch there is also provided a pocket into which used facial tissues are placed which may be later removed for proper disposal. There may also be provided a pocket into which a lip balm or lip stick tube may be placed. The lip balm pocket is located preferably on the flap which may thus serve also as a place to grab in order to pull open the flap. The opening to the lip balm pocket is preferably elasticized so that the lip balm may be taken out and reinserted using one hand.

9 Claims, 3 Drawing Sheets

POUCH FOR HOLDING AND DISPENSING FACIAL TISSUES

BACKGROUND OF THE INVENTION

1. Field of the Invention

This invention most generally relates to a pouch designed for holding and dispensing facial tissues from small pocket sized packages which pouch is removably attachable to a selectable location of the body of the person using the pouch or attachable to any surface which provides convenient access to users such as auto dashboards, boats, bicycles, motorcycles and the like. More particularly, the pouch is preferably made of pliable and soft material such as a moisture proof or moisture repelling fabric, is preferably attachable to an arm or leg of the user and includes a closable flap which when opened exposes the facial tissue for removal and use and which flap may additionally contain such items as licenses, passes, note pads and the like. In the preferred pouch there is also provided a pocket into which used facial tissues are placed which may be later removed and properly disposed of. Even more particularly, the pouch is designed to be attached to the forearm of the user even over outer garments which are typically worn during such activities as skiing, hiking, mountaineering, biking, skating, hunting and almost any activity which may make it normally inconvenient, while engaged in the activity, to get a facial tissue and properly store it after use for later and proper disposal.

2. Description of the Prior Art

Presently there is nothing available of which the Applicant herein is aware, that is reasonable in cost and simple to use and that permits a user to conveniently and safely access facial tissues for use while at the same time being involved in physically difficult and demanding activity or activity which makes a normal access to facial tissue typically located in a purse or pocket, impossible or difficult or, at the least, inconvenient and perhaps even dangerous or hazardous for the user.

None of the prior art which is known to the inventor hereof satisfies the need for this ability to safely and conveniently access facial tissue and after the use thereof place the tissue in a pocket of the pouch for later and proper disposal.

SUMMARY OF THE INVENTION

The present invention in it's most simple form or embodiment is directed to a pouch designed for holding and dispensing facial tissues from small pocket sized packages which pouch is removably attached to a selectable location of the body of the person using the pouch or t a surface convenient to the user. The pouch is preferably made of pliable and soft material such as a moisture proof or moisture repelling fabric, is preferably attachable to an arm or leg of the user and includes a closable flap which when opened exposes the facial tissue for removal and use and which flap may additionally contain such items as licenses, passes, note pads and the like. In the preferred pouch there is also provided a pocket into which used facial tissues are placed for later removal and proper disposal. There may be provided a pocket into which a lip balm or lip stick tube may be placed. The lip balm pocket is located preferably on the flap which may thus serve also as a place to grab to pull open the flap. The lip balm pocket opening may be elasticized so that the lip balm may be taken out and reinserted using one hand.

a primary object of the invention is to provide a pouch for holding and dispensing facial tissues comprising: wall means defining a main pocket, the main pocket sized to accept within the a main pocket a pocket-pack of facial tissues and the main pocket having an opening therein through which the pocket-pack may be passed into and out of the main pocket. A tissue dispensing aperture is appropriately located through and on an upward facing wall so as to permit proper access to and dispensing of facial tissues from the pocket-pack located within the main pocket. There is also provided a means for removably attaching the pouch to a selectable body location of a suer of the pouch.

A further primary object of the invention is to provide the pouch for holding and dispensing facial tissues as described above but further comprising a means for covering and exposing the tissue dispensing aperture. The means for covering and exposing the tissue dispensing aperture is preferably an openable and closable flap which when opened exposes both the facial tissue for removal and use and the main pocket opening. The openable and closable flap further may include means for protectably displaying articles such as ski passes, licenses, note pads, photographs and the like. Additionally there may be means for securing, such as with VELCRO ® brand of fastening material, the flap in a position covering the tissue dispensing aperture.

Yet another primary object of the invention is to provide the pouch for holding and dispensing facial tissues as described above but further comprising a means for storing used facial tissue for later disposal. The means for storing used facial tissue for later disposal is preferably a pocket having an opening through which used facial tissues are passed and placed into the storing pocket and which used tissues may be later removed and properly disposed of. The used tissue pocket is typically located on a wall opposite the upward facing wall that contains the aperture through which the facial tissues are dispensed. There may also be provided a lip balm pocket into which a lip balm or lip stick may be placed. The lip balm pocket is located preferably on the flap which may thus serve also as a place to grab in order to pull open the flap. The opening to the lip balm pocket is preferably elasticized so that the lip balm may be taken out and reinserted using one hand. The means for removably attaching the pouch to a selectable body location of a user is typically a strap having a means for connecting ends of said strap such as VELCRO ® brand of fastening material. The strap has sufficient length to wrap around the selectable body location such as the forearm, wrist, thigh, calf etc. of the user. Also the means for removably attaching the pouch to a selectable body location of a user may be a piece of VELCRO ® brand of fastener attached to the pouch and a mating piece attached to the user or to the clothing worn by the user at the location where the user plans to removably attach the pouch. The mating piece may also be located on a convenient surface such as an auto dashboard. The pouch may be made substantially from material such as for example; nylon, rayon, DACRON ® brand of fabric material, GORTEX ® brand of fabric material, leather silk, cotton, flexible plastic and wool.

These and further objects of the present invention will become apparent to those skilled in the art after study of the present disclosure of the invention.

DESCRIPTION OF THE PREFERRED EMBODIMENTS

Figure 3:
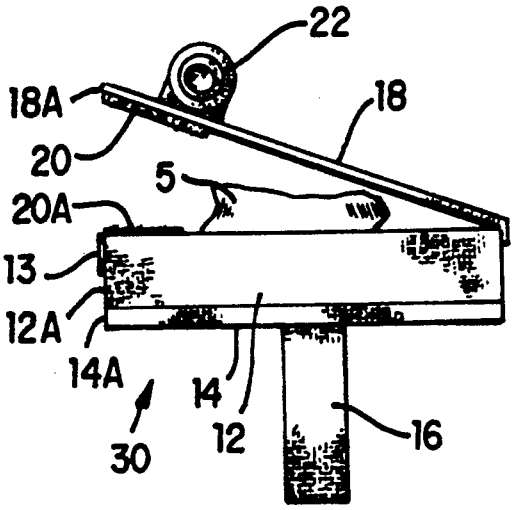
FIG. 3 is a side pictorial illustration but showing the lip balm pocket located on the flap which is openable and closable over the tissue dispensing opening.
Figure 4:
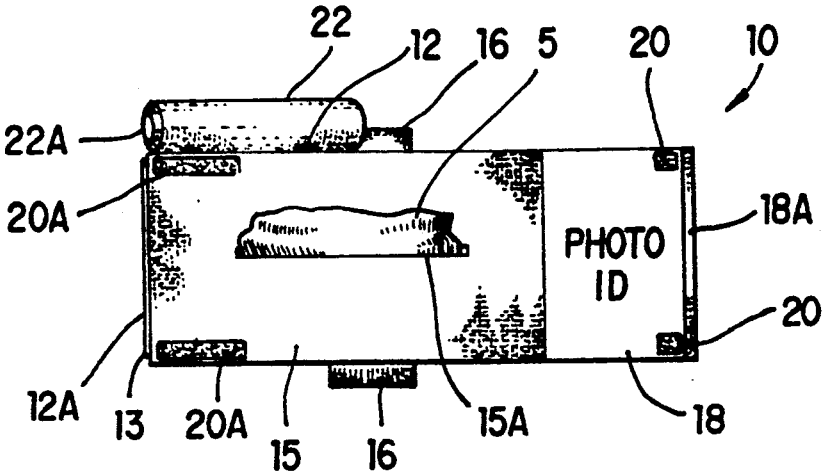
FIG. 4 is a top view sketch illustrating, the tissue dispensing opening and also showing a generic symbol for a photo ID placed with the flap.
Figure 5:
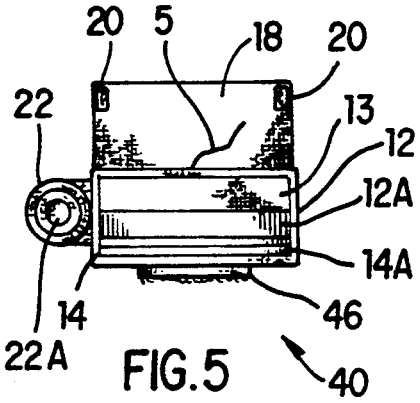
FIG. 5 is a front pictorial illustration showing the openings into the main pocket and into the used tissue pocket and also into the lip balm pocket as in FIG. 2 but showing one component of VELCRO® brand of fastener which would be used to attach to a second component on clothing of the user.
Figure 6:
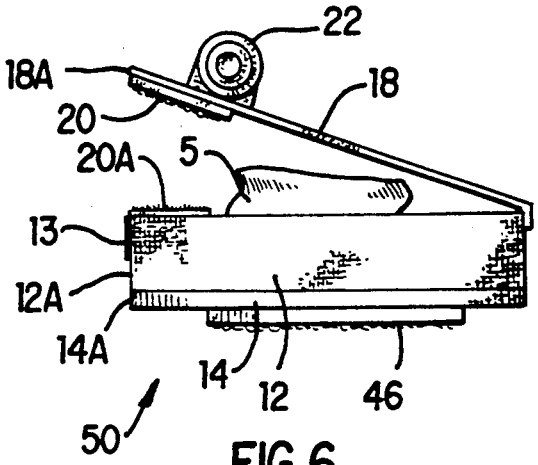
FIG. 6 is a side pictorial illustration of the pouch of FIG. 5 but showing the lip balm pocket located on the flap which is openable and closable over the tissue dispensing opening.

The following is a description of the preferred embodiment of the invention. While the user would typically place the pouch 10 on the forearm, clearly the pouch 10 may be attached or placed on the thigh or calf of the leg providing the attaching straps 16 are sufficiently long to do so. FIGS. 1–4 illustrate a pouch 10 having either closable and openable straps or an elastic or stretchable band both identified using numeral 16. In FIGS. 3 and 6 a lip balm pocket 22 is shown located on the flap 18. In FIGS. 5 and 6 each of pouch 40 and 50 has means for attachment to the user 46 shown as a piece of VELCRO® brand of fastener. Obviously, the pouch 40 or 50 could be attached to the surface of an auto if the proper piece of VELCRO® brand of fastener was appropriately positioned. The means for connecting or attaching the pouch could be any form such as for example, VELCRO®, snaps, buttons, eyelet and laces, hooks and eyes and any of the metal types of fasteners used with clothing. The straps illustrated by numeral 16 could also be a spring type of device similar to the clips used to restrain trouser pant legs while bicycle riding.

It is obvious to one or ordinary skill, that the pouch 10, 30, 40, 50 or 60 may be made from many different materials having many different designs and color schemes all to suit the taste of the user. Typically, pouches 10, 30, 40, 50 or 60 would be made of a soft material which is substantially water proof or at least water repellent such as nylon etc.. The preferred means for attaching (16 or 46) the pouch would be straps using VELCRO® brand of fastener identified by numerals 16A, 16B and 20, 20A. The main pocket 12 which would hold the pocket-pack of facial tissues would be dimensioned to receive the standard size or sizes of such pocket-packs.

Reference is now made to FIGS. 1–7, all of which illustrate pictorially, the various elements of several of the embodiments of the invention. In order to fully disclose the invention, the pouch will be described, under certain circumstances, based upon the manner in which it would be used.

Figure 1:
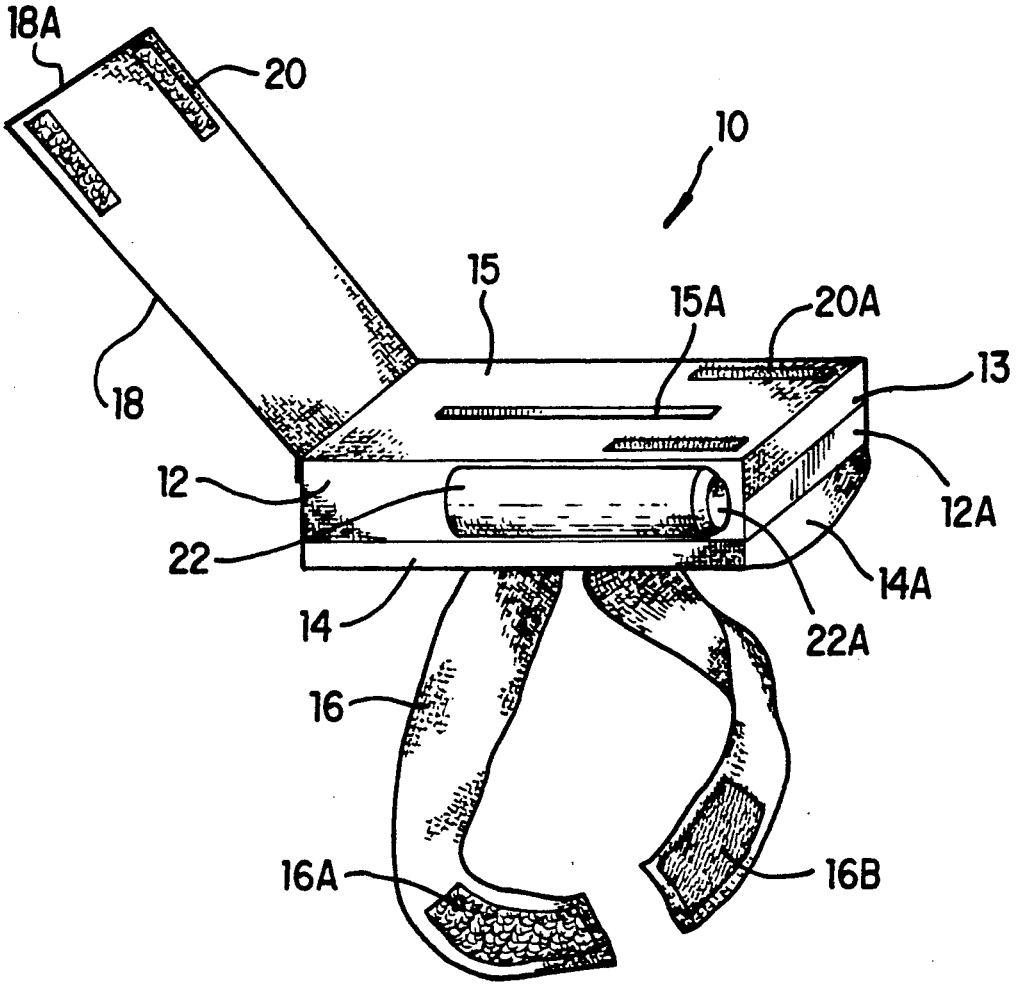
FIG. 1 is a perspective pictorial illustration of the arrangement of the various elements of the pouch for holding and dispensing facial tissues showing the lip balm pocket on the side of the the main tissue holding pocket and the used tissue pocket on the underneath side of the main pocket.
Figure 7:
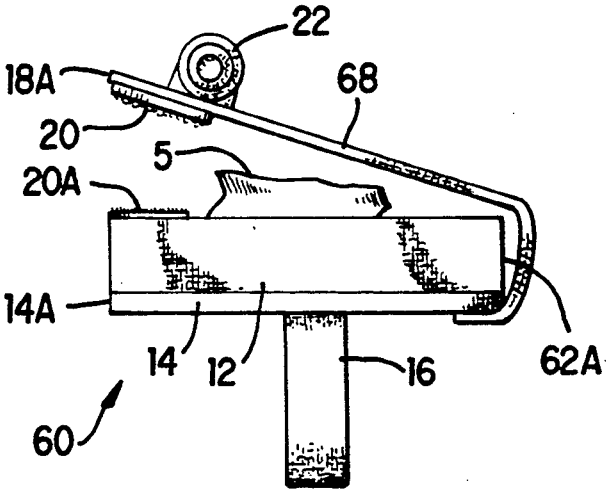
FIG. 7 is a side pictorial illustration but showing the lip balm pocket located on the flap which flap is openable and closable over both the tissue dispensing aperture and the used tissue storing pocket opening.

FIG. 1 illustrates pouch 10 to a selectable body location of the user being shown as straps 16 and VELCRO® brand of fasteners 16A and 16B. The user would insert a pocket-pack of facial tissues into main pocket 12 through main opening 12A or 62A in FIG. 7. Main pocket opening 12A has a partial cover 13 to inhibit the inadvertent falling out of the pocket-pack from pocket 12. Clearly the means for preventing such unintended or inadvertent falling out could be, among many other things, elasticized opening edges, a removable cover, a simple elastic band, or it could be two (2) overlapping panels which would have to be separated upon inserting or removing the pocket-pack of tissues from main pocket 12. While not illustrated, it is obvious that the opening into the main pocket 12 could be closed and opened by the opening and closing of flap 18 whether the main pocket opening 12A was located as is shown in FIGS. 1–6 or the opening was at an end opposite that end, as shown in FIG. 7. Flap 18 needs only to be configured to wrap around the opening 12A as shown or be "hinged" to the downward facing surface of main pocket 12 so that the opening 62A into main pocket 12 situated at the opposite end is covered over when flap 68 is in the closed position. A first tissue or a tissue 5 (FIGS. 2–7) is pulled into tissue dispensing aperture 15A which is appropriately located through surface 15 of main pocket 12. Means for covering and exposing the tissue 5 and aperture 15A is openable and closable flap 18. Flap 18 is held in the covering position by fasteners 20 and 20A. A lip balm or lip stick tube may be placed into pocket 22 through opening 22A which opening is designed to partially close, by preferably being elasticized or the like, after the tube has been inserted. The tube is likewise easily removable using one hand only because of the design of the opening 22A.

Pouch 10 is attached to typically the forearm, either the right or the left depending on user preference, using straps 16 and fasteners 16A and 16B. While the user is, for example, riding a chair lift or on a ski slope, there is easy and convenient access to facial tissues and to lip balm without having to fumble through clothing pockets and perhaps inadvertently dropping things from the users clothing pockets. After using a tissue the user would conveniently place the used tissue into means for storing 14 used facial tissue for later disposal. Means for storing is preferably a pocket 14 into which tissue is placed through opening 14A. Opening 14A may be closable using any well known fasteners such as buttons, snaps, or VELCRO® brand. When the user finds it convenient, the used tissue may be properly disposed.

Flap 18 may also have means for protectably displaying articles such as ski passes, licenses, note pads, photographs and the like. Means for protectably displaying articles is shown in the form of a display pocket into which such items are placed through opening 18A. Flap 18 may be made so that objects will be displayed through plastic on both the outer facing and the inner facing surface of flap 18.

Figure 2:
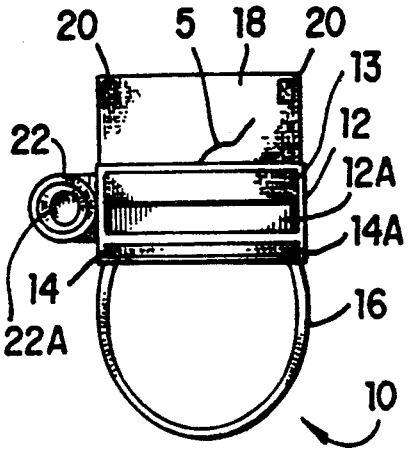
FIG. 2 is a front pictorial illustration showing the openings into the main pocket and into the used tissue pocket and also into the lip balm pocket—the straps for attaching the pouch to the forearm is illustrated as an elastic band which is to be slipped onto the forearm of the user.

FIG. 2 illustrates pouch 10 with means for removably attaching pouch 10 to a selectable body location of the user being shown as an elastic band 16 which may be slipped over the users hand onto the forearm or if the band 16 is large enough, it could be put onto the leg. FIG. 3 is similar to FIG. 2 where now pouch 30 has the lip balm pocket 22 located on flap 18. Pocket 22 would also serve as a handle for opening flap 18 to expose tissue 5. FIG. 4 simply shows the dispensing opening 15A through which tissue 5 passes. As is well known, when tissue 5 is removed a new tissue takes the same position of the tissue removed unless, of course, there are none left.

FIGS. 5 and 6 illustrate substantially pouches 10 and 30 but with means for removably attaching the pouch 40 or 50 to the clothing of the user being one component of a two component fastening system such as VELCRO® brand of fastening system.

FIG. 7 is an illustration of the pouch 60 showing the lip balm pocket 22 located on the flap 68 which flap 68 is openable and closable over both the tissue dispensing aperture 15A and the used tissue storing pocket opening 62A.

It is certainly understood that while the preferred embodiment of the invention is removably attachable to the forearm or the leg of the user it may also be incorporated into or made removably attachable to articles of clothing sport bags and the like. In addition, there may be a plurality of pockets provided on any of the available surfaces even though a single lip balm pocket 22 is described as being on the flap 18 or 68 or on a side wall of main pocket 12.

It is thought that the pouch for holding and dispensing facial tissues of the present invention and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A pouch for holding and dispensing facial tissue comprising:

pliable and soft wall means defining a main pocket, said main pocket sized to accept within said main pocket a pocket-pack of facial tissues and said main pocket having an opening therein through which said pocket-pack may be passed into and out of said main pocket;

a tissue dispensing aperture appropriately located through and on an upward facing wall of said wall means so as to permit proper access to and dispensing of facial tissues from said pocket-pack located within said main pocket;

means for removably attaching said pouch to a selectable body supporting location of a user;

means for covering and exposing said tissue dispensing aperture, wherein said means for covering and exposing said tissue dispensing aperture is an openable and closable flap which when opened exposes the facial tissue for removal and use, and wherein said openable and closable flap further comprises means for protectably displaying articles such as ski passes, licenses, note pads, photographs;

means for securing said openable and closable flap in a position covering said tissue dispensing aperture; and means for storing used facial tissue for later disposal.

2. A pouch for holding and dispensing facial tissues comprising:

pliable and soft wall means defining a main pocket, said main pocket sized to accept within said main pocket a pocket-pack of facial tissues and said main pocket having an opening therein through which said pocket-pack may be passed into and out of said main pocket;

a tissue dispensing aperture appropriately located through and on an upward facing wall of said wall means so as to permit proper access to and dispensing of facial tissues from said pocket-pack located within said main pocket;

means for removably attaching said pouch to a selectable body supporting location of a user;

means for covering and exposing said tissue dispensing aperture, wherein said means for covering and exposing said tissue dispensing aperture is an openable and closable flap which when opened exposes the facial tissue for removal and use;

means for securing said openable and closable flap in a position covering said tissue dispensing aperture;

means for storing used facial tissue for later disposal wherein said means for storing used facial tissue for later disposal is a used tissue storing pocket having an opening through which used facial tissues are passed and placed into said storing pocket and from which used facial tissues may be later removed for proper disposal thereof, said pocket located on a wall opposite said upward facing wall of said wall means; and at least one lip balm pocket into which a lip balm tube may be placed, said at least one lip balm pocket located on an outward facing surface of at least one wall of said wall means defining said main pocket, said lip balm pocket having an elasticized opening through which said lip balm may be removed and reinserted into said lip balm pocket, said elasticized opening configured for permitting one hand removal and insertion of said lip balm.

3. The pouch for holding and dispensing facial tissues according to claim 1 wherein said means for storing used facial tissue for later disposal is a used tissue storing pocket having an opening through which used facial tissues are passed and placed into said storing pocket and from which used facial tissues may be later removed for proper disposal thereof, said pocket located on a wall opposite said upward facing wall of said wall means and wherein said openable and closable flap further comprises means for covering said storing pocket opening.

4. The pouch for holding and dispensing facial tissues according to claim 3 further comprising at least one lip balm pocket into which a lip balm tube may be placed, said at least one lip balm pocket located on an outward facing surface of at least one wall of said wall means defining said main pocket, said lip balm pocket having an elasticized opening through which said lip balm may be removed and reinserted into said lip balm pocket, said elasticized opening configured for permitting one hand removal and insertion of said lip balm.

5. The pouch for holding and dispensing facial tissues according to claim 4 wherein said lip balm pocket is located on said openable and closable flap which may thus serve also as a pull useful to open said flap.

6. The pouch for holding and dispensing facial tissues according to claim 4 wherein said means for removably attaching said pouch to a selectable body location of a user is a strap having a means for connecting ends of said strap and said strap having sufficient length to wrap around said selectable body location and said pouch being made substantially from material selected from the list consisting of nylon, rayon, DACRON ® brand of fabric material, GORTEX ® brand of fabric material, leather, silk, cotton, flexible plastic and wool.

7. The pouch for holding and dispensing facial tissues according to claim 5 wherein said means for removably attaching said pouch to a selectable body location of a user is a strap having a means for connecting ends of said strap and said strap having sufficient length to wrap around said selectable body location and said pouch being made substantially from material selected from the list consisting of nylon, rayon, DACRON ® brand of fabric material, GORTEX ® brand of fabric material, leather, silk, cotton, flexible plastic and wool.

8. The pouch for holding and dispensing facial tissues according to claim 4 wherein said means for removably attaching said pouch to a selectable body location of a user is a one component of a means for connecting said pouch to said selectable body location at which body location is positioned a second component of said means for connecting said pouch, and said pouch being made substantially from material selected from the list consisting of nylon, rayon, DACRON ® brand of fabric material, GORTEX ® brand of fabric material, leather, silk, cotton, flexible plastic and wool.

9. The pouch for holding and dispensing facial tissues according to claim 5 wherein said means for removably attaching said pouch to a selectable body location of a user is a one component of a means for connecting said pouch to said selectable body location at which body location is positioned a second component of said means for connecting said pouch, and said pouch being made substantially from material selected from the list consisting of nylon, rayon, DACRON ® brand of fabric material, GORTEX ® brand of fabric material, leather, silk, cotton, flexible plastic and wool.

* * * * *